US009242369B1

(12) United States Patent
Richmond, Jr.

(10) Patent No.: US 9,242,369 B1
(45) Date of Patent: Jan. 26, 2016

(54) CREEPER FOR UNDERNEATH AN AUTOMOBILE DASHBOARD

(71) Applicant: Prince Richmond, Jr., Montgomery, AL (US)

(72) Inventor: Prince Richmond, Jr., Montgomery, AL (US)

( * ) Notice: Subject to any disclaimer, the term of this patent is extended or adjusted under 35 U.S.C. 154(b) by 0 days.

(21) Appl. No.: 14/730,496

(22) Filed: Jun. 4, 2015

(51) Int. Cl.
*B25H 5/00* (2006.01)

(52) U.S. Cl.
CPC ..... *B25H 5/00* (2013.01)

(58) Field of Classification Search
CPC ..... B25H 5/00; A61G 1/0231; A61G 1/0225; B62B 2202/42; B62B 5/0083
See application file for complete search history.

(56) References Cited

U.S. PATENT DOCUMENTS 780,653 A * 1/1905 Griffith ..... B62B 5/0083 280/35
1,130,080 A * 3/1915 Germond ..... B66F 9/06 187/232
1,132,983 A * 3/1915 Shuey ..... B25H 5/00 280/32.6
1,144,760 A * 6/1915 Fekete ..... A61G 1/04 280/32.6
1,248,839 A * 12/1917 Fravel ..... B25H 5/00 280/32.6
1,298,381 A * 3/1919 Pace ..... B25H 5/00 280/32.6
1,349,941 A * 8/1920 Broome ..... 188/5
1,394,493 A * 10/1921 Grazer ..... A47C 1/146 280/32.6
1,531,536 A * 3/1925 Benz ..... B25H 5/00 280/32.6
1,572,273 A * 2/1926 May ..... A47D 13/08 280/87.051
1,831,408 A * 11/1931 Cremer ..... B25H 5/00 280/32.6
1,976,170 A * 10/1934 Hoover ..... A47C 16/04 182/230
2,084,957 A * 6/1937 Hulbert ..... B25H 5/00 280/32.6
2,104,372 A * 1/1938 August ..... B60S 13/00 280/32.6
2,183,066 A * 12/1939 Fields ..... B62B 1/18 280/43.1
2,574,389 A * 11/1951 Harrold ..... B25H 5/00 297/391
2,607,050 A * 8/1952 Binschoff ..... A61G 7/1017 5/628
2,611,417 A * 9/1952 Henry ..... B25H 5/00 108/129
2,764,411 A * 9/1956 Washburn, Jr. ..... A63B 22/16 280/1
2,790,649 A * 4/1957 Lubbe ..... B41J 29/06 16/48
2,942,693 A * 6/1960 Johnson ..... B25H 5/00 188/5
2,969,123 A * 1/1961 Jamerson ..... B25H 5/00 182/116
2,970,668 A * 2/1961 Snyder ..... B25H 5/00 182/116
3,063,064 A * 11/1962 Mace ..... A47B 3/12 108/166

(Continued)

*Primary Examiner* — Brodie Follman
(74) *Attorney, Agent, or Firm* — Crossley Patent Law

(57) ABSTRACT

A creeper for underneath an automobile dashboard including a platform, a pair of wheels, and a vertical support. The pair of wheels has a right wheel and a left wheel. The pair of wheels is disposed on a bottom surface of the platform proximal a front surface of the platform. The vertical support is continuously disposed on the bottom surface of the platform from proximal a right surface of the platform to proximal a left surface of the platform. The vertical support is disposed proximal a back surface of the platform. A width of the platform substantially conforms to a length of a footwell in a front seat of an automobile.

3 Claims, 3 Drawing Sheets

(56) References Cited

U.S. PATENT DOCUMENTS 3,105,698 A * 10/1963 Bonarrigo ..... B62B 5/0083 280/47.131
3,386,749 A * 6/1968 Roudanez ..... B60R 9/08 280/47.24
3,677,569 A * 7/1972 Larson ..... B62B 3/02 108/44
3,949,436 A * 4/1976 Fawess ..... A47C 9/027 297/391
4,181,463 A * 1/1980 Mooney ..... B62B 1/14 104/97
4,185,846 A * 1/1980 Black ..... B25H 5/00 280/11.115
4,376,547 A * 3/1983 Dominko ..... A47C 1/143 280/30
4,397,374 A * 8/1983 Rumage ..... B25H 5/00 182/129
4,505,477 A * 3/1985 Wilkinson ..... A63B 22/16 280/87.041
4,533,151 A * 8/1985 Maitland ..... A47C 1/143 280/20
4,570,957 A * 2/1986 Rose ..... B25H 5/00 188/5
4,721,316 A * 1/1988 Whiteside ..... B25H 5/00 280/32.6
4,771,871 A * 9/1988 Lambracht ..... A45C 5/14 190/1
4,815,761 A * 3/1989 Henderson ..... B62B 1/22 280/47.24
RE33,645 E * 7/1991 Coote ..... B25H 5/00 211/70.6
5,092,615 A * 3/1992 Gregalis ..... B62B 3/02 108/13
5,093,944 A * 3/1992 Winston, Sr. ..... A61G 7/1017 280/47.25
5,108,118 A * 4/1992 Schaevitz ..... B25H 5/00 280/32.6
5,179,746 A * 1/1993 Rogers ..... A61G 1/04 280/47.29
5,233,708 A * 8/1993 Winston, Sr. ..... A61G 7/1038 280/47.25
5,472,219 A * 12/1995 Eckstrum ..... B25H 5/00 188/5
5,887,879 A * 3/1999 Chumley ..... B62B 1/125 280/40
6,217,043 B1 * 4/2001 Chumley ..... B62B 1/125 280/40
6,357,063 B1 * 3/2002 Selby ..... A61G 5/00 280/47.131
6,375,200 B1 * 4/2002 Harter ..... A01M 31/00 280/30
6,698,811 B1 * 3/2004 Schuchman ..... A61G 1/0293 280/23.1
6,811,180 B1 * 11/2004 Molliere ..... A01M 31/006 182/116
6,845,533 B1 * 1/2005 Tulette ..... A61G 1/0231 280/47.131
7,032,907 B1 * 4/2006 Marsh ..... B25H 5/00 280/32.5
7,070,189 B2 7/2006 Grauss
7,182,351 B2 * 2/2007 Williams ..... A47D 13/04 280/32
7,407,177 B2 * 8/2008 Darling, III ..... A61G 1/013 280/47.18
7,479,097 B2 * 1/2009 Rosborough ..... A63B 22/16 446/396
7,631,380 B1 * 12/2009 Larson ..... A61G 1/0293 280/47.131
7,632,223 B2 * 12/2009 Alexiadis ..... A47C 9/025 128/845
7,810,190 B1 * 10/2010 Antonio ..... A61G 1/013 5/625
8,002,289 B2 * 8/2011 Diaz ..... B25H 5/00 188/5
8,151,937 B2 * 4/2012 Blemel ..... A47C 9/027 182/115
8,209,803 B2 * 7/2012 Bandel ..... A61G 1/04 5/625
8,403,524 B2 * 3/2013 Prosey ..... F21S 4/003 280/32.6
8,424,899 B1 * 4/2013 Larson ..... A61G 1/0231 280/640
8,573,607 B2 * 11/2013 Meacham ..... B25H 5/00 104/97
2001/0024022 A1 * 9/2001 Antirose ..... B25H 5/00 280/32.6
2002/0060437 A1 * 5/2002 Whiteside ..... B25H 5/00 280/32.6
2003/0075384 A1 * 4/2003 Pickering ..... B25H 5/00 182/116
2003/0168824 A1 * 9/2003 Miles ..... B25H 5/00 280/32.6
2004/0113530 A1 6/2004 Anderson
2006/0028819 A1 * 2/2006 Shankland ..... B25H 3/06 362/253
2006/0082084 A1 * 4/2006 Rush ..... B25H 5/00 280/32.6
2006/0138738 A1 * 6/2006 McKenna ..... B62B 1/262 280/47.131
2006/0186619 A1 * 8/2006 Sieb ..... B25H 5/00 280/32.6
2007/0090619 A1 * 4/2007 Lundh ..... B62B 9/12 280/63
2008/0309035 A1 * 12/2008 Whiteside ..... B25H 5/00 280/32.6
2010/0066069 A1 * 3/2010 Bradshaw ..... B60R 9/06 280/769
2010/0176619 A1 * 7/2010 Cahaan ..... A61G 1/013 296/20
2010/0237111 A1 * 9/2010 Mroczka ..... A45F 3/04 224/156
2011/0049822 A1 * 3/2011 Hinman ..... B25H 5/00 280/32.6
2011/0099717 A1 * 5/2011 Windauer ..... A61G 1/013 5/627
2012/0049471 A1 * 3/2012 Meacham ..... B25H 5/00 280/32.6
2012/0091673 A1 * 4/2012 Meacham ..... B25H 5/00 280/32.6
2015/0165816 A1 * 6/2015 Bar Shlomo ..... B44D 3/126 220/570

* cited by examiner

CREEPER FOR UNDERNEATH AN AUTOMOBILE DASHBOARD

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various types of creepers are known in the prior art. However, what has been needed is a creeper for underneath an automobile dashboard including a platform, a pair of wheels having a right wheel and a left wheel, and a vertical support. What has also been needed is for the pair of wheels to be disposed on a bottom surface of the platform proximal the front surface, with each of the right wheel and the left wheel disposed proximal a right surface and a left surface, respectively. Lastly, what has been needed is for the vertical support to be continuously disposed on the bottom surface of the platform from proximal the right surface to proximal the left surface. The platform has a width that substantially conforms to a length of a footwell in a front seat of an automobile. The creeper for underneath an automobile dashboard thus allows a user to secure the vertical support and a section of the platform within a footwell of an automobile so that the user can easily and comfortably perform work under the dashboard of the automobile while lying on the platform.

FIELD OF THE INVENTION

The present invention relates to creepers, and more particularly, to a creeper for underneath an automobile dashboard.

SUMMARY OF THE INVENTION

The general purpose of the present creeper for underneath an automobile dashboard, described subsequently in greater detail, is to provide a creeper which has many novel features that result in a creeper for underneath an automobile dashboard which is not anticipated, rendered obvious, suggested, or even implied by prior art, either alone or in combination thereof.

To accomplish this, the present creeper for underneath an automobile dashboard has a platform having a right surface, a left surface, a front surface, a back surface, a top surface, and a bottom surface. A pair of wheels having a right wheel and a left wheel is disposed on the bottom surface of the platform proximal the front surface. Each of the right wheel and the left wheel is disposed proximal the right surface and the left surface, respectively. A vertical support is continuously disposed on the bottom surface of the platform from proximal the right surface to proximal the left surface. The vertical support is disposed proximal the back surface. The vertical support and the platform are perpendicularly disposed. A width of the platform substantially conforms to a length of a footwell in a front seat of an automobile. The vertical support is configured to engage the footwell of the automobile to allow a user to lie atop the platform while performing work on a dashboard of the automobile.

The vertical support can optionally be wood. The vertical support can also optionally be metal.

Thus has been broadly outlined the more important features of the present creeper for underneath an automobile dashboard so that the detailed description thereof that follows may be better understood and in order that the present contribution to the art may be better appreciated.

BRIEF DESCRIPTION OF THE DRAWINGS

FIGURES

Figure 1:
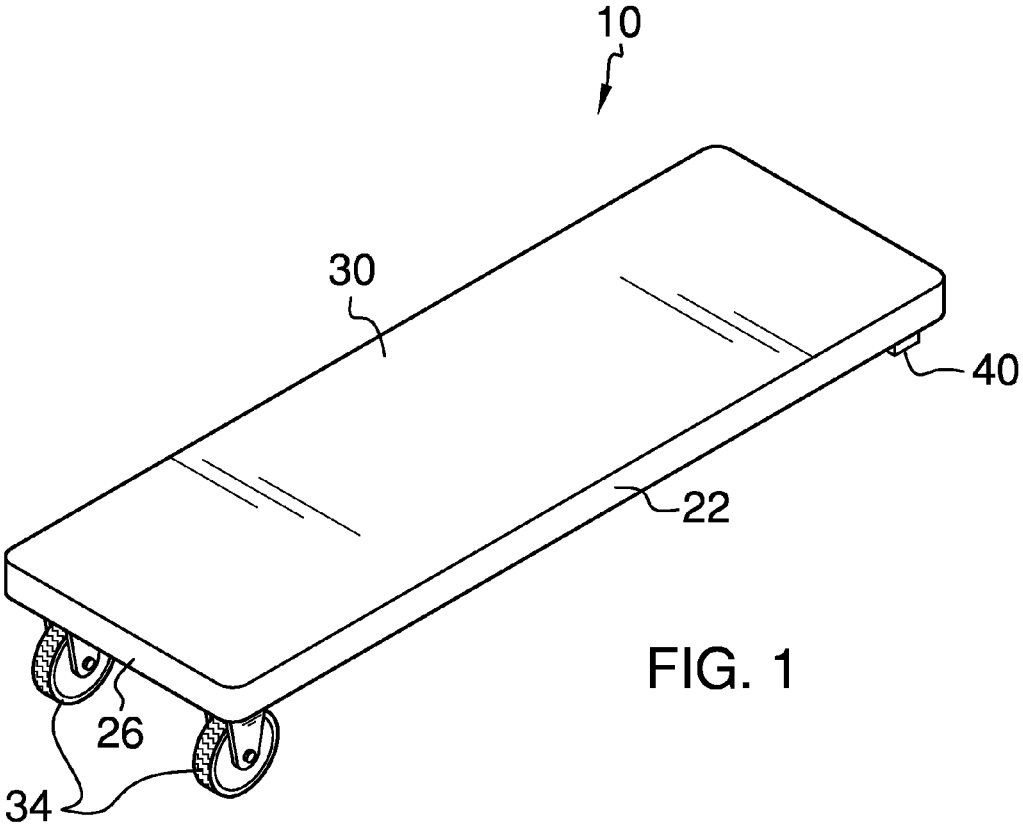
Figure 2:
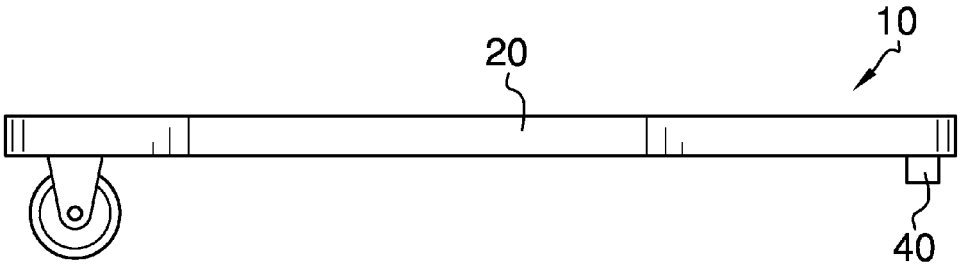
Figure 3:
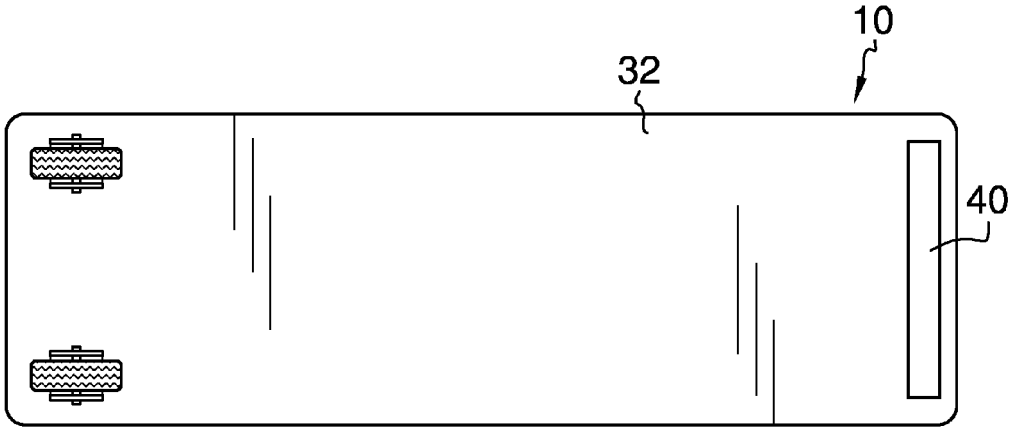
Figure 4:
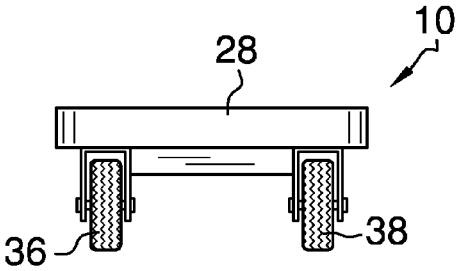
Figure 5:
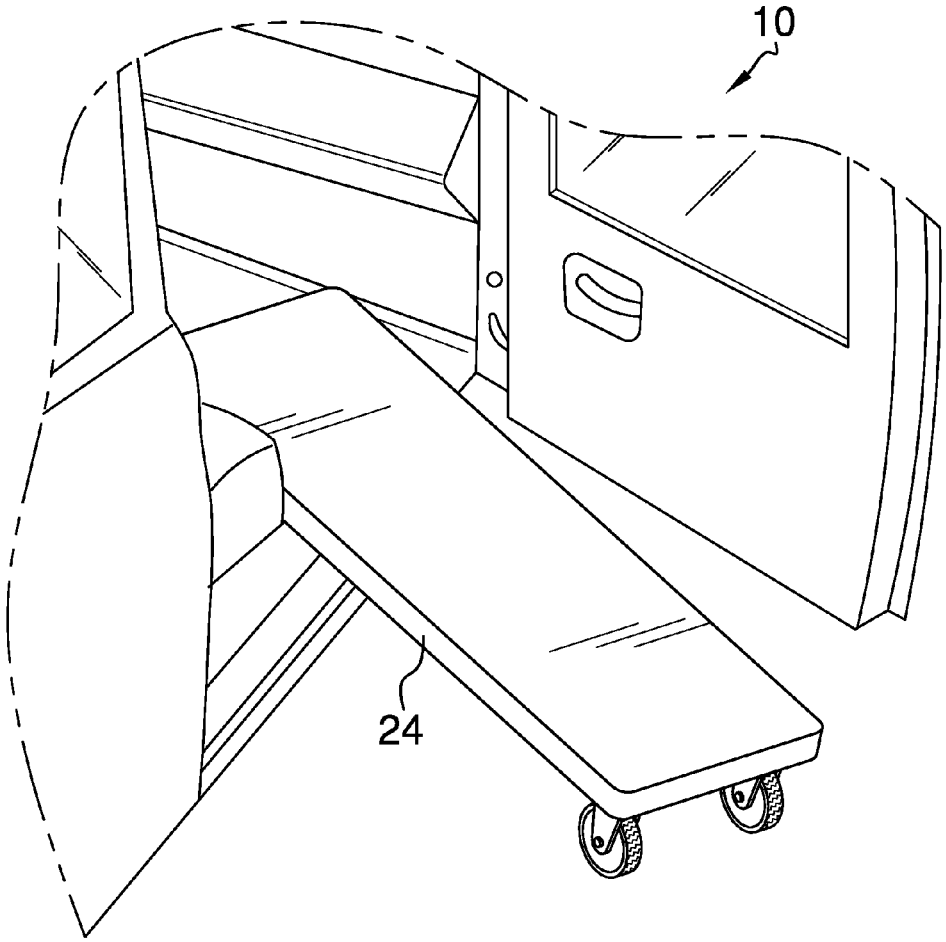

FIG. 1 is a front isometric view.
FIG. 2 is a side elevation view.
FIG. 3 is a bottom plan view.
FIG. 4 is a rear elevation view.
FIG. 5 is an in-use view.

DETAILED DESCRIPTION OF THE DRAWINGS

With reference now to the drawings, and in particular FIGS. 1 through 5 thereof, an example of the instant creeper for underneath an automobile dashboard employing the principles and concepts of the present creeper for underneath an automobile dashboard and generally designated by the reference number 10 will be described.

Referring to FIGS. 1 through 5 the present creeper for underneath an automobile dashboard 10 is illustrated. The creeper for underneath an automobile dashboard 10 has a platform 20 having a right surface 22, a left surface 24, a front surface 26, a back surface 28, a top surface 30, and a bottom surface 32. A pair of wheels 34 having a right wheel 36 and a left wheel 38 is disposed on the bottom surface 32 of the platform 20 adjacent to the front surface 26. Each of the right wheel 36 and the left wheel 38 is disposed proximal the right surface 22 and the left surface 24, respectively. A vertical support 40 is continuously disposed on the bottom surface 32 of the platform 20 from proximal the right surface 22 to proximal the left surface 24. The vertical support 40 is disposed proximal the back surface 28. The vertical support 40 and the platform 20 are perpendicularly disposed. As best shown in FIG. 3, a length of the vertical support 40 is less than a width of the platform 20.

What is claimed is:

1. A creeper for underneath an automobile dashboard comprising:

a platform having a right surface, a left surface, a front surface, a back surface, a top surface, and a bottom surface;

a pair of wheels comprising a right wheel and a left wheel, the pair of wheels disposed on the platform bottom surface adjacent to the front surface, each of the right wheel and the left wheel disposed proximal the right surface and the left surface, respectively; and a vertical support continuously disposed on the platform bottom surface from proximal the right surface to proximal the left surface, the vertical support disposed proximal the back surface;

wherein a length of the vertical support is less than a width of the platform;

wherein the vertical support and the platform are perpendicularly disposed;

wherein a width of the platform substantially conforms to a length of a footwell in a front seat of an automobile;

wherein the vertical support is configured to engage the footwell of the automobile to allow a user to lie atop the platform while performing work on a dashboard of the automobile.

2. The creeper for underneath an automobile dashboard of claim 1 wherein the vertical support is wood.

3. The creeper for underneath an automobile dashboard of claim 1 wherein the vertical support is metal.

* * * * *